US007141930B2

(12) United States Patent
Morizot et al.

(10) Patent No.: US 7,141,930 B2
(45) Date of Patent: Nov. 28, 2006

(54) CONNECTION OF A PLASMA PANEL TO ITS ELECTRICAL POWER SUPPLY IN AN IMAGE DISPLAY DEVICE

(75) Inventors: Gérard Morizot, Voiron (FR); Jean-Raphaël Bezal, Meylan (FR); Gérard Rilly, St Etienne Crossey (FR)

(73) Assignee: Thomson Licensing, Boulogne-Billancourt (FR)

( * ) Notice: Subject to any disclaimer, the term of this patent is extended or adjusted under 35 U.S.C. 154(b) by 297 days.

(21) Appl. No.: 10/909,902

(22) Filed: Aug. 2, 2004

(65) Prior Publication Data

US 2005/0029958 A1 Feb. 10, 2005

(30) Foreign Application Priority Data

Aug. 5, 2003 (FR) ..... 03 09633

(51) Int. Cl.
*H01J 17/49* (2006.01)

(52) U.S. Cl. ..... 313/583; 313/582; 313/584

(58) Field of Classification Search ..... 345/37, 345/41, 60, 71; 313/582–587; 315/169.4
See application file for complete search history.

(56) References Cited

U.S. PATENT DOCUMENTS

2004/0169472 A1* 9/2004 Rilly et al. ..... 313/582

FOREIGN PATENT DOCUMENTS

JP 2000089723 * 3/2000

* cited by examiner

*Primary Examiner*—Joseph Williams
*Assistant Examiner*—Bumsuk Won
(74) *Attorney, Agent, or Firm*—Joseph J. Laks; Harvey D. Fried; Patricia A. Verlangier

(57) ABSTRACT

An image display device is disclosed including a metallic support plate carrying, on its front face, a plasma discharge display with an array of adjacent pairs of electrodes and, on its back face, a power supply. The power supply circuit of each pair of adjacent electrodes forms a current loop starting from the power supply and passing through the electrode then the electrode of the pair, the connection end of the electrode being linked to the power supply by means of a transverse electrical conductor placed on the front side of said metallic plate. According to the invention, the transverse conductor linked to the electrode forms a non-zero angle with said pair of electrodes. The differences in inductance between the various current loops of the display are thus reduced such that the differences in luminance between the various discharge regions of the plasma display are reduced.

10 Claims, 3 Drawing Sheets

CONNECTION OF A PLASMA PANEL TO ITS ELECTRICAL POWER SUPPLY IN AN IMAGE DISPLAY DEVICE

FIELD OF THE INVENTION

The invention relates to the connection of a plasma display to a power supply and a control means for the display.

BACKGROUND OF THE INVENTION

With reference to the appended FIGS. 1 and 2, the Patent Application FR 2 826 765 describes an image display device including a metallic support plate 1 carrying, on its front face, a plasma discharge display and, on its back face, a discharge power supply and a control means 13 for the display. The plasma display itself includes a front panel 3 and a back panel 4 and has at least a first array of electrodes used notably for maintaining discharges by the application of voltage pulses between adjacent electrodes 7, 8 of two different series of electrodes of this first array, the electrodes having connection ends 11, 12 emerging from one side of said display. The power supply circuit for each pair of adjacent electrodes 7, 8 of two different series forming a current loop starting from the power supply and control means and passing through a first electrode 7 and then a second electrode 8 of the pair, where the connection ends of the electrodes 7, 8 of the two different series are situated on opposite edges 5, 6 of the display and where, for each pair of adjacent electrodes 7, 8 of two different series, said current loop of the power supply circuit of this pair does not enclose the metallic plate 1.

Preferably, the connection ends of one of the series of electrodes 8 emerging from the side 6 of the display are linked to the power supply and control means 13 by means of transverse electrical conductors 21 placed on the front side of the metallic plate 1 and extending from said ends to the opposite side 5 of the display. All the power supply conductors of the electrodes are brought to the same side of the display and all the electrodes of the array are then able to be connected to the power supply and control means at a same side of the display. A single electrical power supply can thus conveniently be used to generate all the positive and negative (or null) voltage alternations of the sustain pulses.

This device also has the advantage of limiting the eddy current losses in the metallic plate (the current loop does not enclose the metallic plate) while also obtaining discharge regions of identical impedance between adjacent electrodes (current flowing through the same electrode lengths, whichever electrode pair 7, 8 is considered).

In this device, the transverse conductors are generally grouped into one or more banks of conductors. In FIG. 2, two banks of conductors 23, 24 of reduced width are provided, for example, and are disposed parallel to the base of the plasma display between the sides 5 and 6 to link the display power supply and control means 13 to the connection ends 12 of the series of electrodes 8, which are common electrodes, on the side 6 of the display. One of these banks of conductors is disposed in the upper part of the display and the other in the lower part. Furthermore, they are both inserted between the display back panel 4 and the metallic plate 1. It should be noted that, in this figure, the display power supply and control means 13 are shown beside the plasma display in order to show their connections to the banks of conductors 23 and 24, whereas they are, of course, in reality situated behind the metallic plate 1, as indicated in FIG. 1.

Given the position of the banks of conductors 23 and 24 with respect to the plasma display, differences in luminance between the display area situated at the same level as a bank of conductors and the display area situated between the banks of conductors may be observed. This is caused by differences in inductance between the current loops of the power supply circuits of the various pairs of adjacent electrodes 7, 8. Indeed, the power supply circuit of each pair of adjacent electrodes 7, 8 forms a current loop starting from the power supply and control means 13 passing through a first electrode 7 followed by the second electrode 8 of the pair, then through one of the banks of conductors 23, 24, before closing itself back at the power supply and control means 13. For the pairs of electrodes 7, 8 located near to the banks of conductors, the corresponding current loops have a smaller surface area and hence a lower inductance. The current loops associated with the pairs of electrodes 7, 8 that are located further away from the banks of conductors have a greater surface area. These current loops therefore exhibit a higher inductance. Given that the shape of the discharge in the plasma display discharge regions is very sensitive to this variation in inductance, this leads to a disparity in the light emission and hence a difference in the luminance between the plasma display discharge regions that are near to the banks of conductors and the other plasma display discharge regions.

One solution could be to provide a bank of conductors covering the entire surface of the display so as to only create current loops of minimal surface area. However, this solution has numerous drawbacks, notably a high material and production cost and a high parasitic capacitance is created between the common electrodes 8 and the bank on the one hand, and the metallic plate 1 on the other.

SUMMARY OF THE INVENTION

Accordingly, the present invention is directed to an image display device that allows the differences in luminance between the various display discharge regions to be reduced. The image display device includes a metallic support plate carrying, on its front face, a plasma discharge display and, on its back face, power supply and control means for the discharges of the display. The plasma discharge display, itself includes a front panel and back panel and has at least a first array of electrodes notably for maintaining discharges by the application of voltage pulses between adjacent electrodes of two different series of electrodes of this first array. The electrodes of the first array having connection ends emerging from one side of the display. The connection ends of the electrodes of the two different series are situated on opposite edges of the display. The power supply circuit for each pair of adjacent electrodes of two different series forming a current loop, starting from the power supply and control means, passing through a first electrode then the second electrode of the pair. The current loop of the power supply circuit of this pair not enclosing the metallic plate. The connection ends of one of the series of electrodes emerging from one side of the display being linked to the power supply and control means by means of transverse electrical conductors placed on the front side of said metallic plate and extending from said connection ends to the opposite side of the display. Each transverse conductor is linked to an electrode corresponding to a pair of adjacent electrodes to form a non-zero angle with the pair of electrodes.

Current loops with substantially equal inductances are created for all the pairs of adjacent electrodes of the plasma display. As such, there is little difference in luminance between the various discharge regions of the plasma display.

Preferably, the transverse electrical conductors are grouped into at least one bank of conductors inserted between the back panel and the metallic plate.

According to a first embodiment, the plasma display device includes a single bank of conductors positioned along a diagonal of the plasma display.

According to a second embodiment, the transverse electrical conductors are grouped into two separate banks of conductors each positioned along its own diagonal of the plasma display.

According to a third embodiment, the transverse electrical conductors are grouped into four separate banks of conductors, two banks being each positioned along its own diagonal of the upper half of the plasma display and the other two banks being each positioned along its own diagonal of the lower half of the plasma display.

According to a fourth embodiment, the transverse electrical conductors are grouped into two separate banks of conductors, one of the banks being positioned along a diagonal of the upper half of the plasma display and the other bank being positioned along the opposing diagonal of the lower half of the plasma display.

According to a fifth embodiment, the transverse electrical conductors are formed by a conducting foil inserted between the back panel and the metallic plate, the dimensions of which foil are substantially equal to those of the plasma display and in which openings are created.

BRIEF DESCRIPTION OF THE DRAWINGS

The invention will be better understood upon reading the following description, presented by way of a non-limiting example, and which makes reference to the appended drawings, among which.

DESCRIPTION OF PREFERRED EMBODIMENTS

In order that the differences between the device of the invention and the prior art are more clearly apparent from the figures, identical references have been used for the elements that provide the same functions and that are located in the same places.

Figure 1:
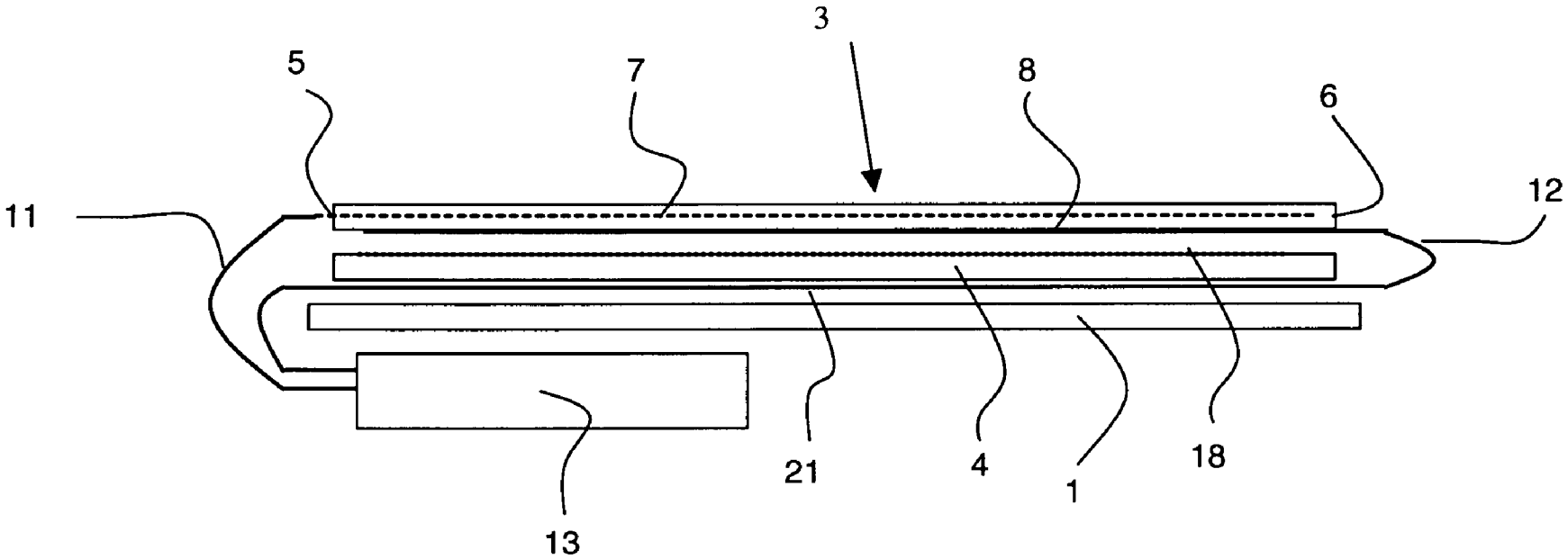
Fig.1 (Prior Art)
FIG. 1 shows a schematic connection diagram of the prior art where the display device is shown in cross section.
Figure 2:
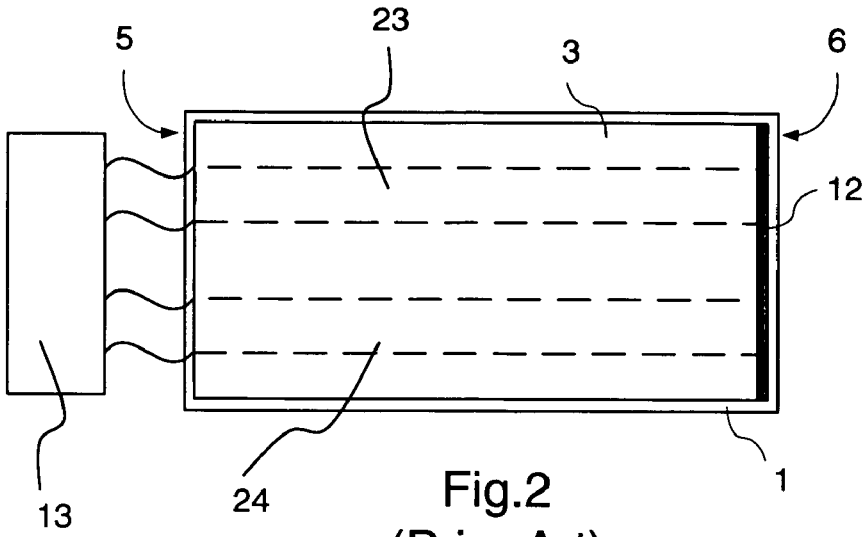
Fig.2 (Prior Art)
FIG. 2 shows a front view of the device depicted in FIG. 1, where the power supply and control means of the device have been displaced to the side of the display.
Figure 3:
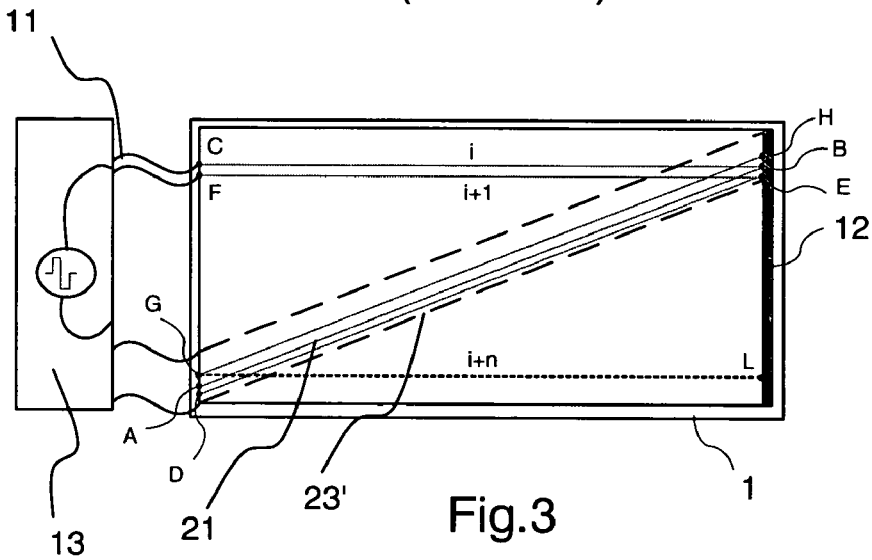
FIG. 3 shows a front view of a first embodiment of a display device according to the invention, where the power supply and control means of the device have also been displaced to the side of the display.

According to the invention, the transverse electrical conductors 21 form a non-zero angle with the pairs of adjacent electrodes 7 and 8, to which they relate. This property is illustrated in FIG. 3. In this figure, the transverse electrical conductors 21 are grouped into a bank 23'. This bank forms a non-zero angle with the pairs of electrodes 7, 8 of the display. In the embodiment shown in FIG. 3, the bank 23' is positioned along a diagonal of the plasma display in between the metallic plate 1 and the back panel 4 of the display.

This feature has the effect of reducing the differences in inductance between the current loops associated with the neighbouring pairs of electrodes 7, 8 and of reducing the differences in inductance between the most inductive current loop and the least inductive current loop of the display.

Thus, the inductance of the current loop associated with a row i of the plasma display situated in the upper part of the display and which is proportional to the area ABC shown in FIG. 3, is little different in relative value from that of the current loop associated with the neighbouring row i+1, proportional to the area DEF. Nor is it very different from that of the row i+n for which the surface area of the associated current loop is GHL.

By adjusting the angle between the pair of electrodes 7, 8 and the transverse conductor 21, the inductance of the current loop can be varied and adapted to the structure of the display and to the type of discharges created in the display.

In order that the invention provides a non-negligible effect, it can be estimated that the angle should be at least equal to 5 degrees.

Figure 4:
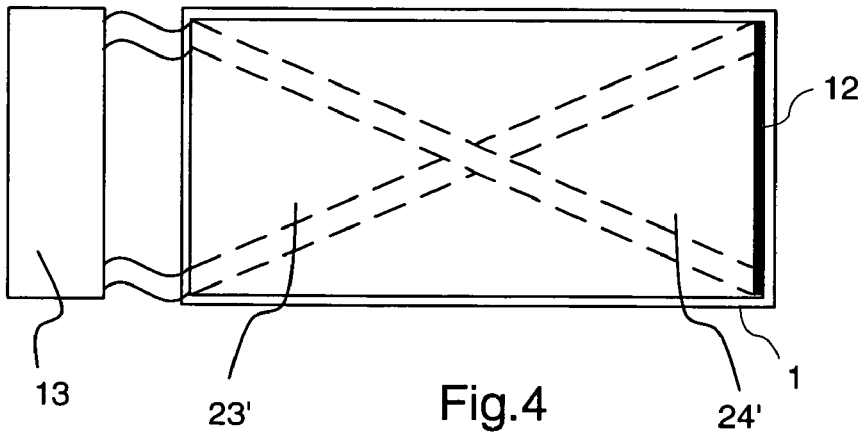
FIG. 4 shows a front view of a second embodiment of a display device according to the invention, where the power supply and control means of the device have also been displaced to the side of the display.

FIG. 4 illustrates a second embodiment of the display device according to the invention. In this embodiment, two banks of conductors 23' and 24' are provided which are isolated from one another and each positioned along a diagonal of the plasma display, in between the metallic plate 1 and the back panel 4.

The width of the banks 23' and 24' is halved compared with the embodiment shown in FIG. 3. This solution allows the distribution of the display current to be shared on the power supply board and its electromagnetic radiation to be reduced.

Figure 5:
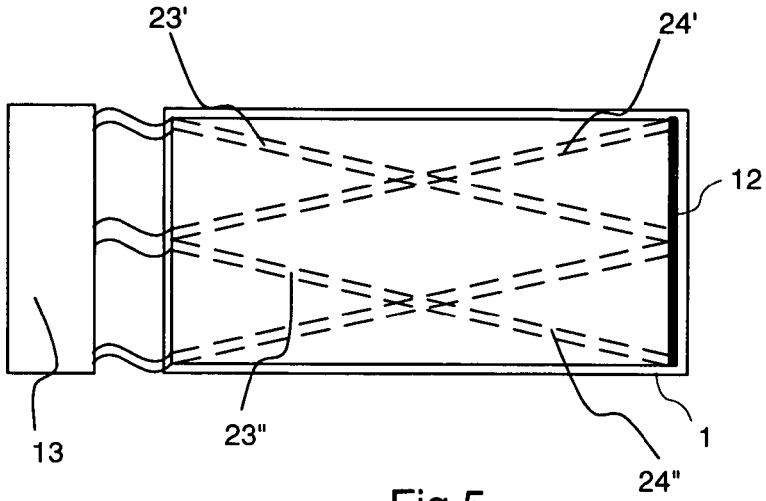
FIG. 5 shows a front view of a third embodiment of a display device according to the invention, where the power supply and control means of the device have also been displaced to the side of the display.

FIG. 5 illustrates a third embodiment of the display device according to the invention. In this embodiment, four banks of conductors, isolated from each other, are provided. Two of them, 23' and 24', are each positioned along their own diagonal of the upper half of the plasma display and the other two, 23" and 24", are each positioned along their own diagonal of the lower half of the plasma display. This allows the width of the banks to be further reduced.

Figure 6:
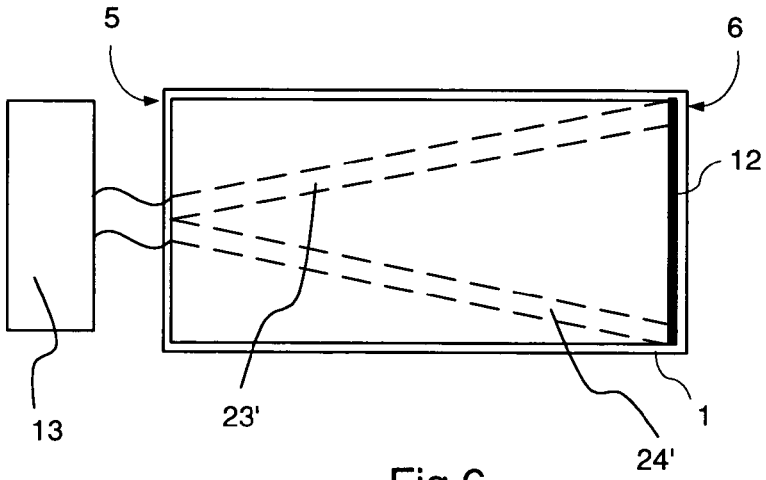
FIG. 6 shows a front view of a fourth embodiment of a display device according to the invention, where the power supply and control means of the device have also been displaced to the side of the display.
Figure 7:
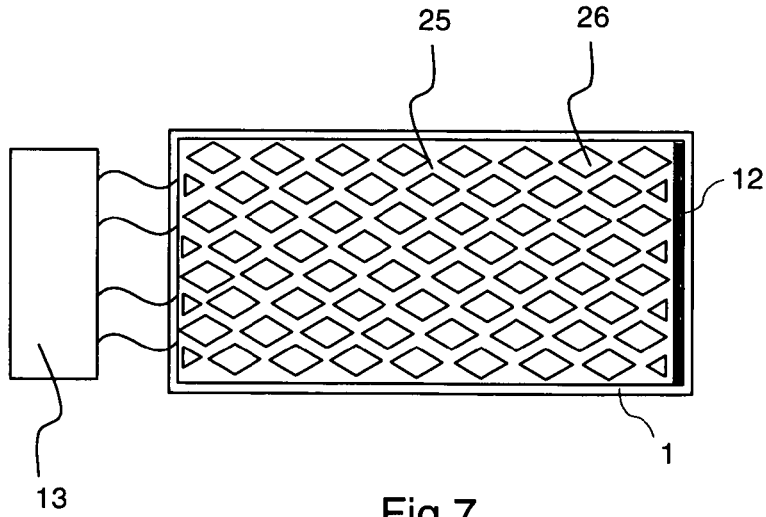
FIG. 7 shows a front view of a fifth embodiment of a display device according to the invention, where the power supply and control means of the device have also been displaced to the side of the display.

FIG. 6 illustrates a fourth embodiment of the display device according to the invention. In this embodiment, two banks of conductors 23' and 24', isolated from one another, are provided. One of them, 23', is positioned along a diagonal of the upper half of the plasma display and the other, 24', is positioned on the opposing diagonal of the lower half of the plasma display, the two banks emerging halfway up the side 5 of the plasma display.

If it is desired to reduce even further the inductance of the current loops, another embodiment consists in forming the transverse electrical conductors by means of a conducting foil inserted between the back panel 4 and the metallic plate 1 and in which openings are created. This embodiment is illustrated in FIG. 5. In this embodiment, a conducting foil 25 is inserted between the back panel 4 and the metallic plate 1. The dimensions of this foil are substantially equal to those of the plasma display. Openings 26, that are uniformly distributed over the whole surface of the foil 25, are created in the latter. In the example shown in FIG. 5, the openings 26 are lozenge or triangular shaped. Other shapes may be envisaged without it being detrimental to the results of the invention. The pitch and the dimensions of the openings can vary depending on the type of discharges in the display.

In this embodiment, the transverse conductor 21 corresponding to a pair of adjacent electrodes 7, 8 is not rectilinear and takes the form of a broken line extending between the sides 5 and 6 of the display. The position of this transverse conductor corresponds to the shortest current path between the power supply and control means 13 and the electrode 8. This embodiment verifies one of the important features of the invention, namely that the transverse conductor forms a non-zero angle with the corresponding pair of adjacent electrodes 7, 8.

With respect to the solution, mentioned in the introduction to the present application, where the transverse electrical conductors 21 would cover the whole height of the back panel 4, this embodiment presents the following advantages. From an electrical point of view, the capacitance between the common electrodes 8 of the display and the metallic plate 1 is very significantly reduced, thus reducing the reactive current losses. From a mechanical point of view, the openings created in the conducting foil allow the plasma display to be bonded, by means of an adhesive layer, to the metallic plate 1, without any openings. Also, an adhesive layer would need to be provided on both surfaces of the conducting foil, which is an additional adhesive layer as compared with the embodiment in FIG. 5.

The invention claimed is:

1. An image display device comprising:

a metallic support plate carrying, on its front face, a plasma discharge display and, on its back face, power supply and control means for the discharge of said plasma discharge display, said plasma discharge display comprising a front panel and back panel, and having at least a first array of electrodes for maintaining discharges by the application of voltage pulses between adjacent electrode of two different series of electrodes of this first array, said electrodes having connection ends emerging from one side of said panel, wherein said connection ends of the electrodes of the two different series are situated on opposite edges of the display, said power supply and control means for each pair of adjacent electrodes of two different series forming a current loop starting from the power supply and control means passing through a first electrode then the second electrode of the pair, said current loop of the power supply and control means of this pair not enclosing the metallic plate, the connection ends of one of the series of electrodes emerging from one side of the display being linked to the power supply and control means by means of transverse electrical conductors placed on the front side of said metallic plate and extending from said ends to the opposite side of the display, wherein each transverse conductor is linked to an electrode corresponding to a pair of adjacent electrodes forming a non-zero angle with said pair of electrodes.

2. The image display device of claim 1 wherein said transverse electrical conductors are grouped into at least one bank of conductors inserted between the back panel and the metallic plate.

3. The image display device of claim 2 wherein a single bank of conductors are positioned along a diagonal of the plasma discharge display.

4. The image display device of claim 2 wherein said transverse electrical conductors are grouped into two separate banks of conductors each positioned along a diagonal of the plasma discharge display.

5. The image display device of claim 2 wherein said transverse electrical conductors are grouped into four separate banks of conductors, two of the banks being positioned along a diagonal of the upper half of the plasma display and the other two banks being positioned along a diagonal of the lower half of the plasma discharge display.

6. The image display device of claim 2 wherein said transverse electrical conductors are grouped into two separate banks of conductors, one of the banks being positioned along a diagonal of the upper half of the plasma display and the other bank being positioned along the opposing diagonal of the lower half of the plasma discharge display.

7. The image display device of claim 1 wherein that the transverse electrical conductors are formed by a conducting foil, inserted between the back panel and the metallic plate, whose dimensions are substantially equal to those of the plasma display and in which openings are created.

8. The image display device of claim 7 wherein that the openings are uniformly distributed over the whole surface of said conducting foil.

9. The image display device of claim 7 wherein the pitch and the dimensions of the openings are determined by the type of the discharges in the plasma discharge display.

10. The image display device of claim 7 wherein an adhesive layer is provided between the metallic plate and the back panel for bonding them to one another through the openings in the conducting foil.

* * * * *